US006968799B2

(12) United States Patent
Humiston, Jr.

(10) Patent No.: US 6,968,799 B2
(45) Date of Patent: Nov. 29, 2005

(54) SAFETY DEVICE

(76) Inventor: Norman John Humiston, Jr., 1117 Route 29, Schuylerville, NY (US) 12871

( * ) Notice: Subject to any disclaimer, the term of this patent is extended or adjusted under 35 U.S.C. 154(b) by 60 days.

(21) Appl. No.: 10/210,381

(22) Filed: Aug. 1, 2002

(65) Prior Publication Data

US 2004/0020419 A1 Feb. 5, 2004

(51) Int. Cl.[7] ..... B63B 9/06; B63B 17/00
(52) U.S. Cl. ..... 114/350; 114/363
(58) Field of Search ..... 114/363, 348, 349, 114/350, 191, 194

(56) References Cited

U.S. PATENT DOCUMENTS 1,133,063 A * 3/1915 Sardynski et al. ..... 114/350
2,195,428 A * 4/1940 Searing ..... 114/194
2,991,489 A * 7/1961 Kubach ..... 114/349
3,351,035 A * 11/1967 Mclean ..... 114/333
3,352,512 A * 11/1967 James, Sr. ..... 104/138.1
3,428,976 A * 2/1969 Robinson ..... 114/363
4,263,863 A * 4/1981 Leitch ..... 114/201 R
4,713,030 A * 12/1987 Ingle ..... 440/99
4,739,953 A * 4/1988 Soffiantini ..... 244/121
5,234,144 A * 8/1993 Iler ..... 224/191
5,297,761 A * 3/1994 Kendall et al. ..... 244/140
5,713,710 A * 2/1998 Strong et al. ..... 414/139.5
6,298,934 B1 10/2001 Shteingold

* cited by examiner

*Primary Examiner*—Sherman Basinger
(74) *Attorney, Agent, or Firm*—Kristen L. Ashdown, Esq.

(57) ABSTRACT

A safety device to prevent a passenger from becoming injured during a crash, severe weather conditions, or other event that could cause bodily harm. The safety device comprises a substantially fracture resistant spherical shell and at least one harnessed passenger seat.

16 Claims, 6 Drawing Sheets

SAFETY DEVICE

BACKGROUND OF THE INVENTION

1. Technical Field

The present invention relates generally to safety devices, and more particularly, to a safety sphere that prevents a passenger therein from becoming injured by adverse external conditions.

2. Related Art

Many external conditions, such as a high speed crash, severe weather conditions, etc., place a person in the path of collision with high speed objects. Accordingly, there exists a need for a safety device that may be used in such situations to protect individuals from being injured by such high speed impacts.

SUMMARY OF THE INVENTION

In a first general aspect, the present invention provides a safety device for use in conjunction with a boat, comprising: a spherical shell; a mechanism for mounting a seat within the spherical shell; and a mechanism for releasably mounting the spherical shell within a cockpit of the boat.

In a second general aspect, the present invention provides a safety device for use in a storm, comprising: a spherical shell; a mechanism for mounting a seat within the spherical shell; and a mechanism for mounting the spherical shell to a secure location during the storm.

The foregoing and other features and advantages of the invention will be apparent from the following more particular description of the embodiments of the invention.

BRIEF DESCRIPTION OF THE DRAWINGS

The embodiments of this invention will be described in detail, with reference to the following figures, wherein like designations denote like elements, and wherein.

DESCRIPTION OF THE PREFERRED EMBODIMENTS

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1:
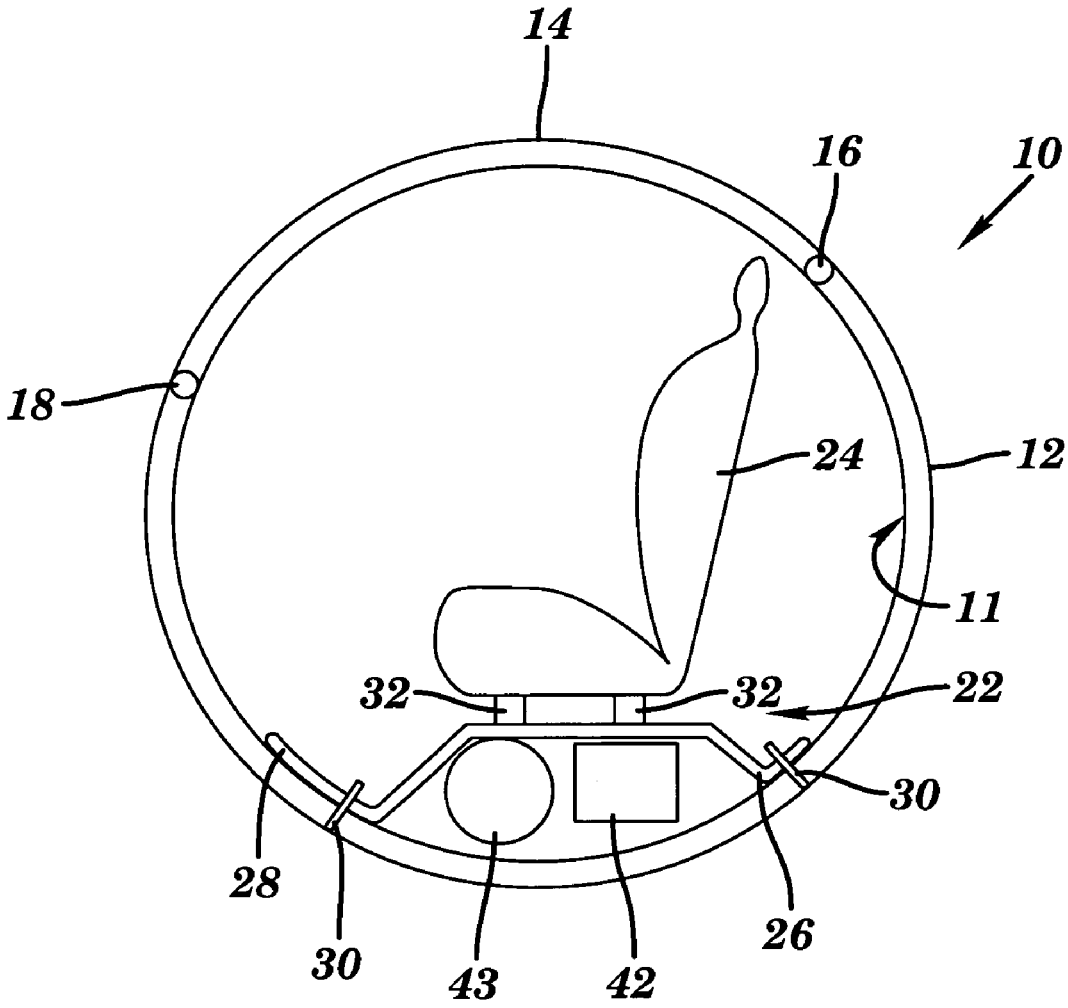
FIG. 1 depicts a safety device in accordance with a first embodiment of the present invention.
Figure 2:
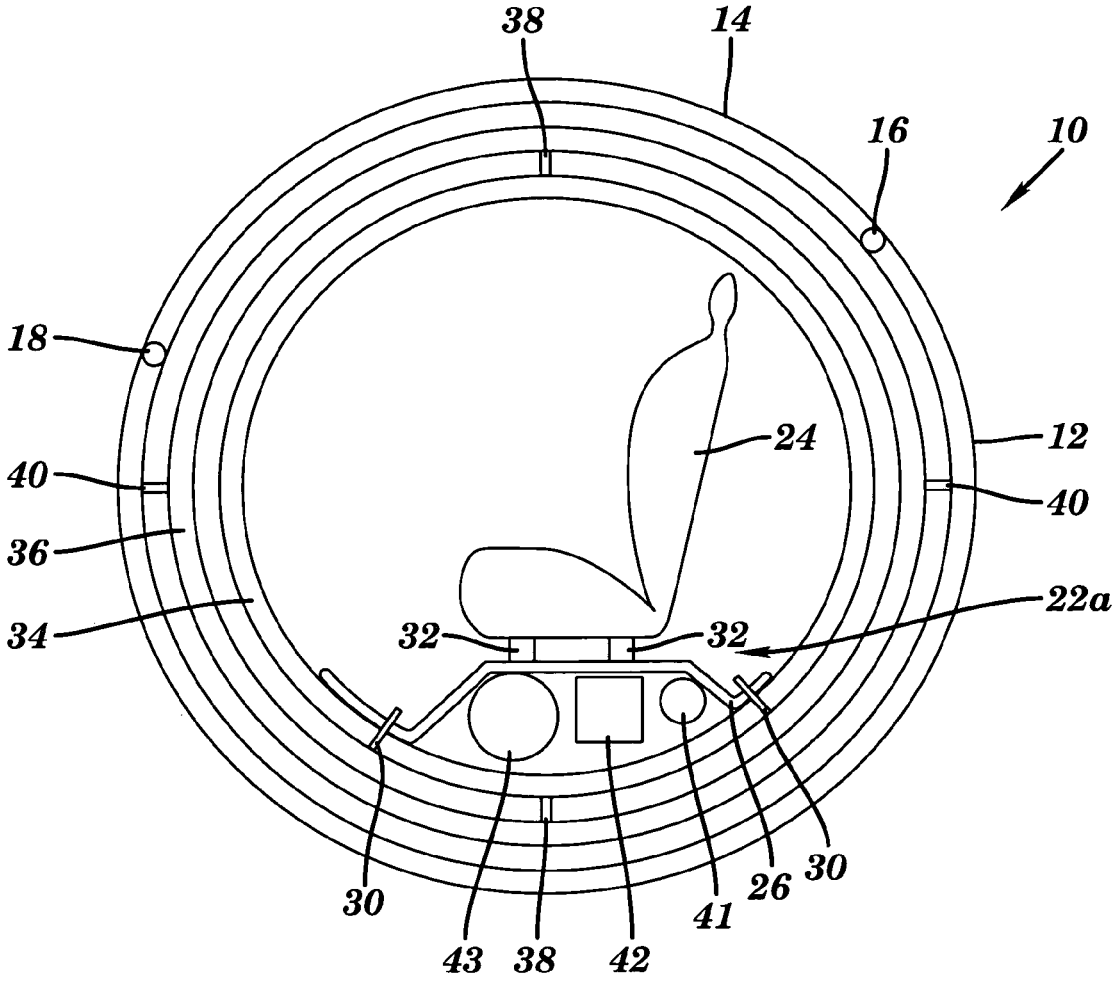
FIG. 2 depicts a safety device in accordance with a second embodiment of the present invention.

Referring to the drawings, FIGS. 1 and 2 illustrate a safety device 10 in accordance with the present invention. The safety device 10 includes a spherical shell 12, the significance of the shape will become apparent infra. The spherical shell 12 comprises a strong material capable of withstanding a crash, severe weather conditions, etc. For example, the spherical shell 12 may be formed of an impact resistant, substantially fracture resistant material, such as a Lexan™ plastic material, or other similarly used material. The thickness of the walls of the spherical shell 12 are of the appropriate thickness to withstand high speed collisions, flying debris, etc. The spherical shell 12 may be substantially transparent, or have a non-transparent portion as desired to protect from the sun or add privacy, etc.

Figure 3:
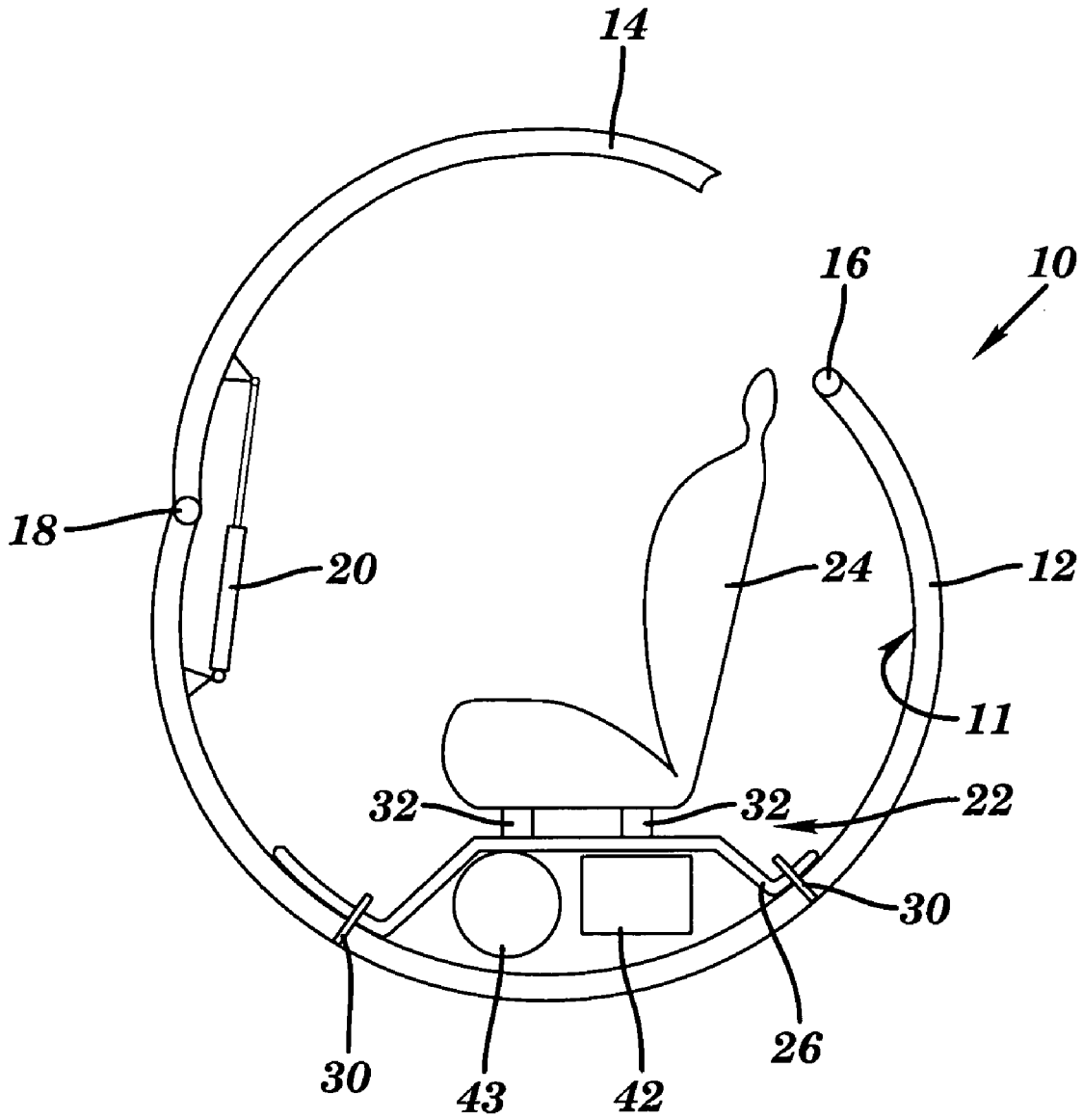
FIG. 3 depicts the safety device of FIG. 1 having a way of ingress and egress.

The spherical shell 12 of the safety device 10 includes a passageway, door or hatch 14 that allows a passenger into and out of the safety device 10. The spherical shell 12 includes a latch 16 and a hinge 18 that allow the hatch 14 to open as further illustrated in FIG. 3. A hydraulic arm 20, or other similar device, may be mounted to an interior surface 11 of the hatch 14 and the spherical shell 12 to assist in the opening and closing of the hatch 14, as further illustrated in FIG. 3. Alternatively, one or two doors may be formed in the side of the spherical shell 12, etc.

The safety device 10 further includes a mechanism 22 for mounting a seat 24 to the spherical shell 12 for a passenger. The seat 24 may be securely fastened in a fixed position to the interior of the spherical shell 11, as illustrated in FIG. 1. The mechanism 22 may include a bracket or platform 26, optionally having a foot rest 28, securely mounted within the spherical shell 12 using fasteners 30. The platform 26 may further include a pair of seat mounts 32 on which the seat 24 is secured to the platform 26.

Alternatively, the seat 24 may be mounted to the spherical shell 12 in a non-fixed position, as illustrated in FIG. 2, to allow the passenger to remain in a substantially upright position even if the safety device 10 is turned upside down. In particular, the mechanism 22*a* further includes the platform 26 securely mounted, using fasteners 30, to an inner ring 34. The inner ring 34 is rotatably mounted within an outer ring 36 at pivot points 38. The outer ring 36 is then rotatably mounted within the spherical shell 12 at pivot points 40. In effect, a gyroscope-type device is created. The passenger's weight may be sufficient to assist in keeping the seat 24 in a substantially upright position at all times. A ballast 41, however, may be added beneath the seat platform 26 to assist in keeping the passenger in a substantially upright position at all times.

The seat 24 may further include a harness (not shown) to secure the passenger in the seat 24 at all times. A safety pack 42 may also be secured beneath the seat platform 26. The safety pack 42 may include a supply of water, first aid materials, a cellular phone, beaconing device, etc. Also provided under the seat 24 is an oxygen tank 43 to supply the passenger with the necessary oxygen in the event the passenger needs to spend extended periods of time within the safety device 10, or the passenger has had the wind knocked out of the them, etc.

Figure 4:
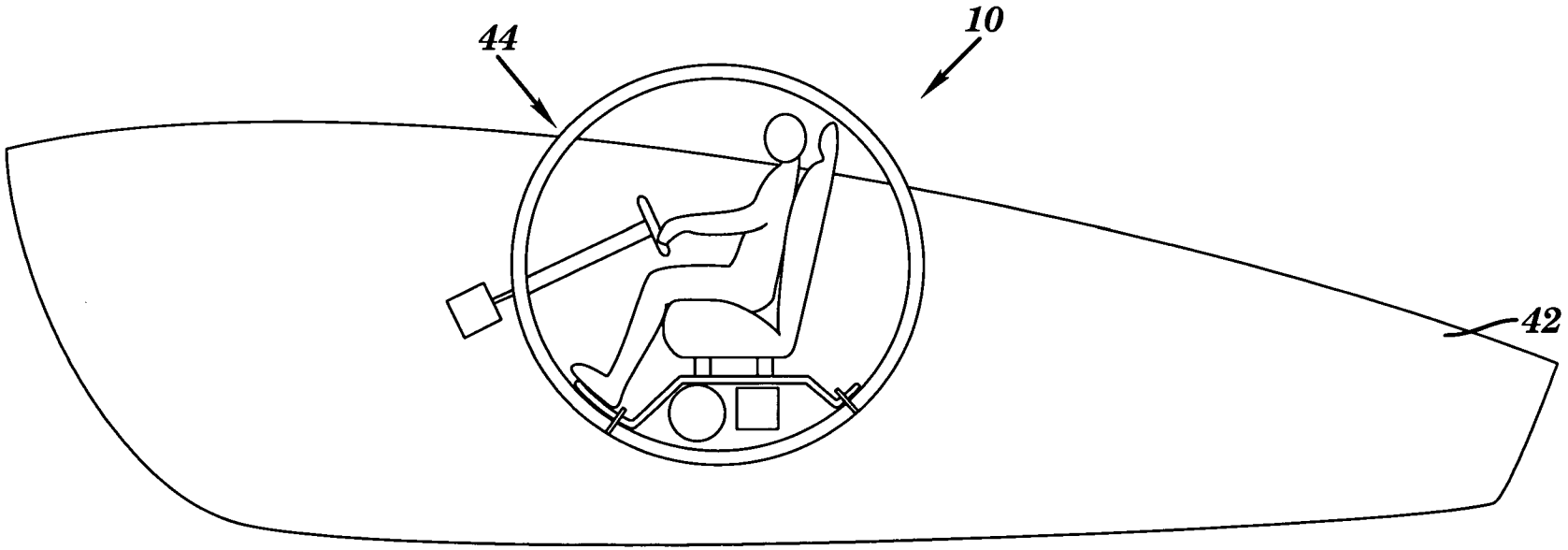
FIG. 4 depicts the safety device of FIG. 1 utilized in conjunction with a boat.

As illustrated in FIG. 4, the safety device 10 may be used in conjunction with a racing boat 42. The safety device 10 may be releasably mounted within the cockpit 44 of the boat 42 in place of a conventional seat. In the event the boat 42 crashes the safety device 10 remains intact and prevents the driver of the boat 42 from being injured or killed. Although the safety device 10 may turn end over end a few times before coming to a stop, the driver of the boat 42 is spared from being thrown against the water, or other objects at high speeds, as is conventionally the case. After the crash the safety device 10 continues to bob up and down in the water until a rescue team comes to retrieve the driver.

Because the safety device 10 is spherical in shape, and mounted down into the cockpit 44 of the boat 42, there is little wind resistance to slow the boat 42. Additionally, the spherical shape of the safety device 10 aids in reducing the force of impact when the safety device 10 hits the surface of the water. The spherical shape also helps to bring the safety device 10 to a faster and less abrupt stop than other shapes.

Figure 5:
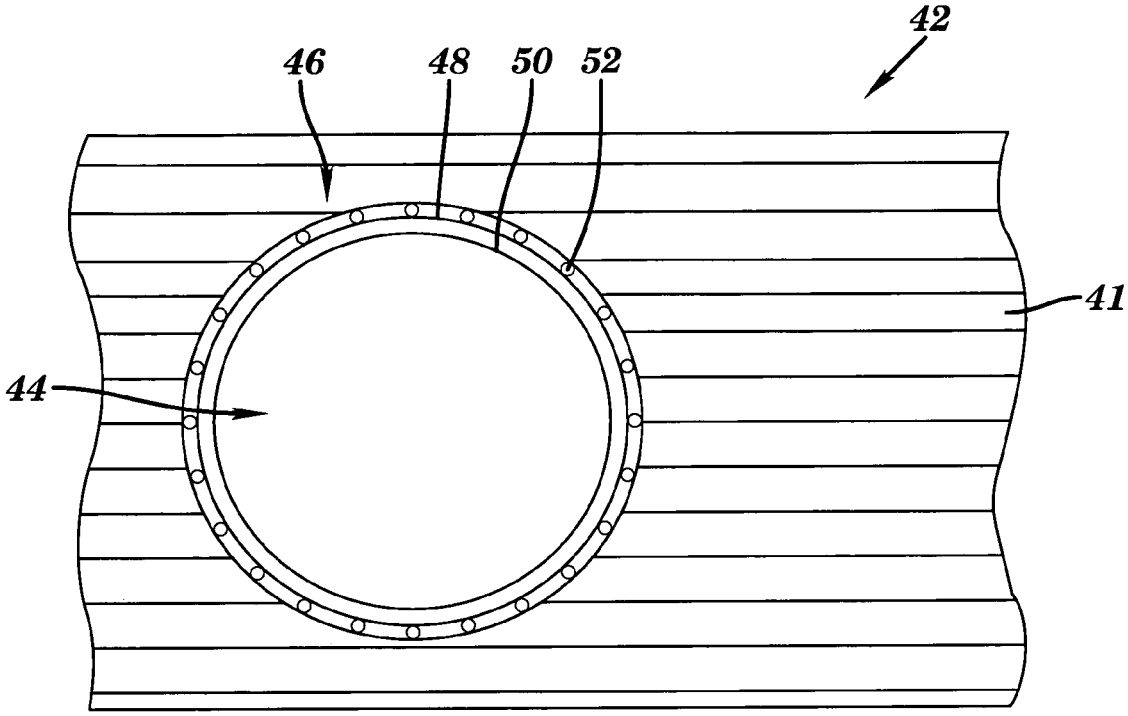
FIG. 5 depicts a mounting device used to mount the safety device in a cockpit of the boat.
Figure 6:
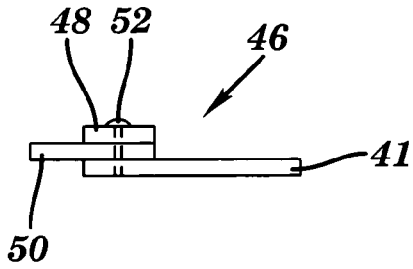
FIG. 6 depicts a cross-sectional view of the mounting device of FIG. 5.

For use in conjunction with boats 42, a mounting device 46 may be secured to the cockpit 44 of the boat 42 to allow the safety device 10 to be releasably mounted therein. FIG. 5 shows a top view of a portion of the boat 42, or the deck 41, having the mounting device 46 attached within the cockpit 44 of the boat 42. As illustrated more clearly in FIG. 6, the mounting device 46 may include a mounting bracket 48 that is securely fastened to the deck 41 of the boat 42. The mounting bracket 48 may comprise metal, or other similar material. The mounting bracket 48 may be composed of more than one strip of material, as needed or desired. A seal 50 formed of a moderately flexible material, such as rubber, may be fixedly attached between the boat deck 41 and the mounting bracket 48 using a fastener 52. The seal 50 may be formed of more than one piece or length of material, as needed or desired.

As was illustrated in FIG. 4, more than half of the safety device 10 is below the top or deck 41 of the boat 42. Accordingly, the portion of the safety device 10 having the largest circumference is below the mounting device 46. This keeps the safety device 10 securely mounted within the cockpit 44 of the boat 42 during normal use of the boat 42. However, when sufficient force is applied, for example, if the boat flips over, and/or breaks apart, the flexible seal 50 within the mounting device 46 will release the safety device 10 and allow the safety device 10 to eject from the boat 42, thereby sparing the driver within the safety device 10 from hitting the water, or other objects, at high speeds.

The safety device 10 is also useful in severe weather conditions, such as a hurricane, tornado, etc. If a person is unable to escape the storm in time, or is interested in filming the storm, they can get inside the safety device 10 as the storm passes by. The strong spherical shell 12 of the safety device 10 deflects debris being thrown about during the storm.

Figure 7:
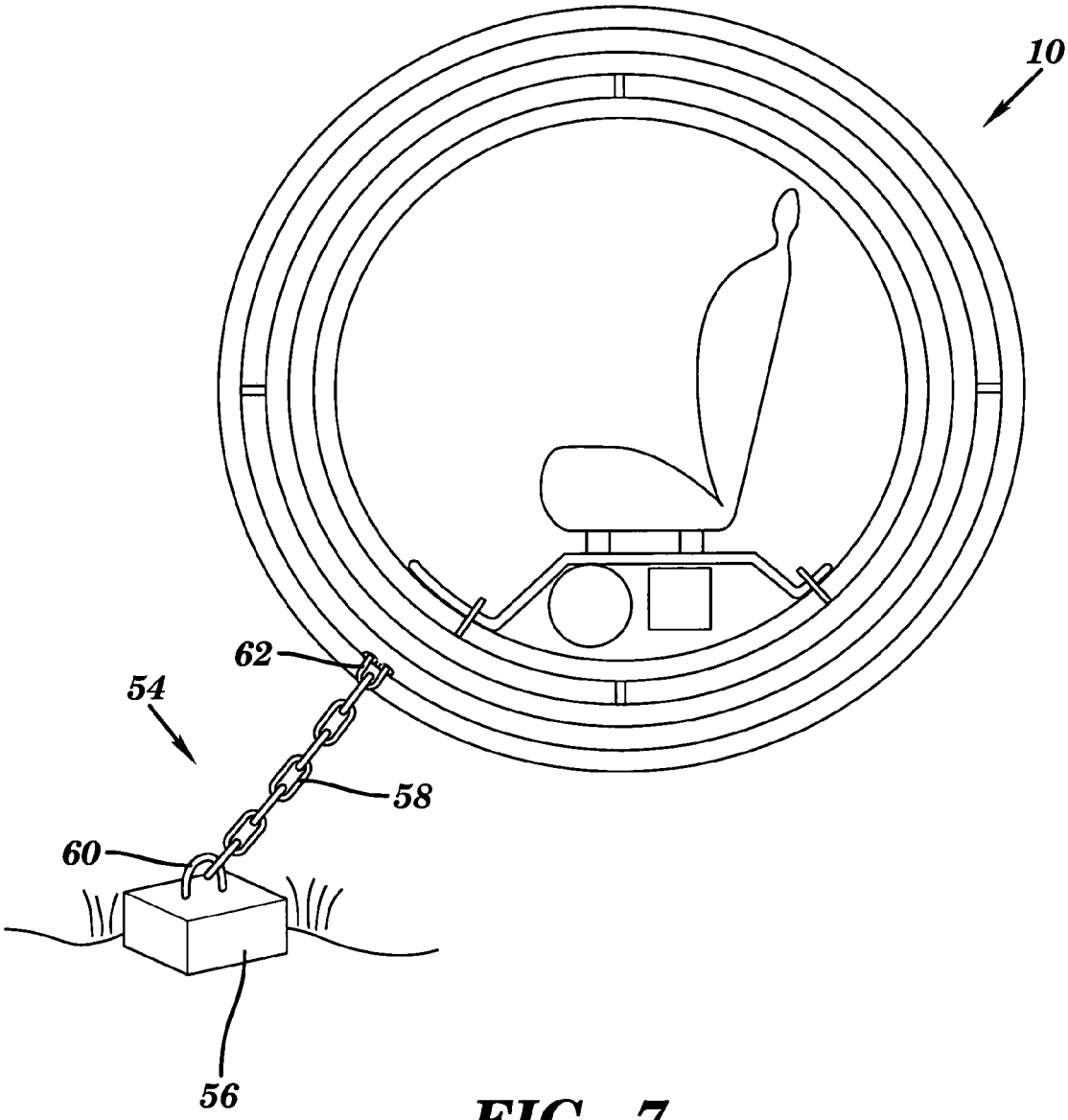
FIG. 7 depicts the safety device utilized in severe weather conditions.

As illustrated in FIG. 7, for use in severe weather conditions the safety device 10 may further include a mechanism 54 for attaching the safety device 10 to a secure location during the storm, such as the ground, etc., to prevent the safety device 10 from being thrown a great distance during the storm. The mechanism 54 may include a ground mounting device 56, such as a bracket, etc., to securely attach the safety device 10 to the ground. The mechanism 54 may also include an attachment device 58, such as a chain, a rope, etc., connecting the ground mounting device 56 to the safety device 10. A first connector 60 may be used to securely connect the attachment device 58 to the ground mounting device 56, and a second connector 62 may be used to securely connect the attachment device 58 to the safety device 10.

Alternatively, the safety device 10 has many other functions. For example, the safety device 10 may be used as a life boat in a ship to get passengers off the ship in an emergency, and so on.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A safety device for use in conjunction with a boat, comprising;

a spherical shell;

a mechanism for fixedly mounting a seat within the spherical shell in a substantially upright seated position; and a mechanism for securely mounting the spherical shell within a cockpit of the boat in a closed position, wherein upon application of a sufficient force the mechanism for mounting the spherical shell within the cockpit of the boat releases the spherical shell in the closed position, and wherein the seat remains in the substantially upright seated position during the release, thereby protecting a passenger within the spherical shell.

2. The safety device of claim 1, wherein the mechanism for mounting the spherical shell within the cockpit of the boat releases the spherical shell when the boat breaks apart.

3. The safety device of claim 1, wherein the safety device further includes a hatch formed within the spherical shell.

4. The safety device of claim 3, wherein the hatch is hingedly mounted to the spherical shell at a first end of the hatch and releasably latched to the spherical shell at a second end of the hatch.

5. The safety device of claim 3, wherein the hatch further includes a hydraulic arm.

6. The safety device of claim 1, wherein the spherical shell comprises an impact resistant, substantially fracture resistant material.

7. The safety device of claim 1, wherein the mechanism for mounting the seat within the spherical shell further comprises a platform fastened within the spherical shell.

8. The safety device of claim 7, wherein the platform further comprises a footrest.

9. The safety device of claim 1, wherein the mechanism for mounting the seat within the spherical shell further comprises:

a first ring rotatably attached within the spherical shell;

a second ring rotatably attached within the first ring; and a platform attached within the second ring to accommodate attachment of the seat.

10. The safety device of claim 9, wherein the platform further comprises a ballast.

11. The safety device of claim 1, further including a safety pack secured within the safety device.

12. The safety device of claim 1, wherein the largest circumference of the spherical shell is mounted within in the cockpit of the boat.

13. The safety device of claim 1, wherein the mechanism for mounting the spherical shell within the cockpit of the boat comprises:

a flexible seal that allows for releasable attachment of the spherical shell within the cockpit of the boat; and a mounting bracket to securely affix the flexible seal to the cockpit of the boat.

14. A safety device for use in a storm, comprising:

a substantially transparent impact resistant spherical shell;

a mechanism for mounting a seat within the spherical shell comprising:

a first ring rotatably attached within the spherical shell;

a second ring rotatably attached within the first ring; and a platform attached to the second ring to accommodate attachment of the seat; and a mechanism for mounting the spherical shell to a secure location during the storm.

15. The safety device of claim 14, wherein the platform further comprises a footrest.

16. The safety device of claim 14, wherein the platform further comprises a ballast.

* * * * *